US005740923A

United States Patent [19]

Mayhew

[11] Patent Number: 5,740,923

[45] Date of Patent: Apr. 21, 1998

[54] STORING AND SORTING RECEPTACLE APPARATUS AND METHOD

[76] Inventor: Karen P. Mayhew, Rte. 1, Box 77B, Stony Point, N.C. 28678

[21] Appl. No.: 710,785

[22] Filed: Sep. 20, 1996

Related U.S. Application Data

[63] Continuation-in-part of Ser. No. 47,009, Nov. 24, 1995, Pat. No. Des. 379,015.

[51] Int. Cl.[6] ..... B42F 17/00

[52] U.S. Cl. ..... 211/10; 248/97; 248/101

[58] Field of Search ..... 211/10, 12; 248/97, 248/98, 99, 101, 132; 232/1 E, 43.2

[56] References Cited

U.S. PATENT DOCUMENTS

| | | | |
|---|---|---|---|
| 1,500,964 | 7/1924 | Starks | 248/97 |
| 3,105,665 | 10/1963 | Starkweather | 248/101 |
| 3,211,367 | 10/1965 | Jessop | 232/43.2 |

FOREIGN PATENT DOCUMENTS

| | | | |
|---|---|---|---|
| 2235179 | 2/1991 | United Kingdom | 232/43.2 |

*Primary Examiner*—James R. Brittain
*Assistant Examiner*—Gerald A. Anderson

[57] ABSTRACT

A method and apparatus for sorting and storing diverse articles wherein the apparatus comprises a base assembly and an integral upstanding storage panel assembly associated therewith. The base assembly forms a bin for receiving articles to be stored and serves the dual function of providing stabilizing support for the entire receptacle. The upstanding storage panel has a front face, a rear face, one or more openings extending orthogonally therethrough, and one or more shelves, each extending rearwardly from the rear face proximal to a corresponding aperture, respectively. A removable annular closure assembly in the form of a collar member insertable into each aperture is provided for temporarily attaching the open-end portion of a flexible storage bag to the panel assembly in the region of a corresponding opening with the remainder or closed-end portion of the storage bag extending rearwardly and reposing on its corresponding shelf. Articles of a first type are adapted to be passed through the elongated transverse slot in the lower portion of the panel assembly for deposit in the base assembly bin whereas articles of a second type are adapted to be passed through the openings in the panel assembly defined by each collar member for deposit in a corresponding flexible storage bag reposing on its shelf behind the front face of the panel assembly.

14 Claims, 5 Drawing Sheets

10

46
46
44
40
44
42
47
14
26
34
36
28
12
30
32
44
40
48
44
42
20
50
14
28
16
18
34
30
36
12
22
24
32
26

FIG 7
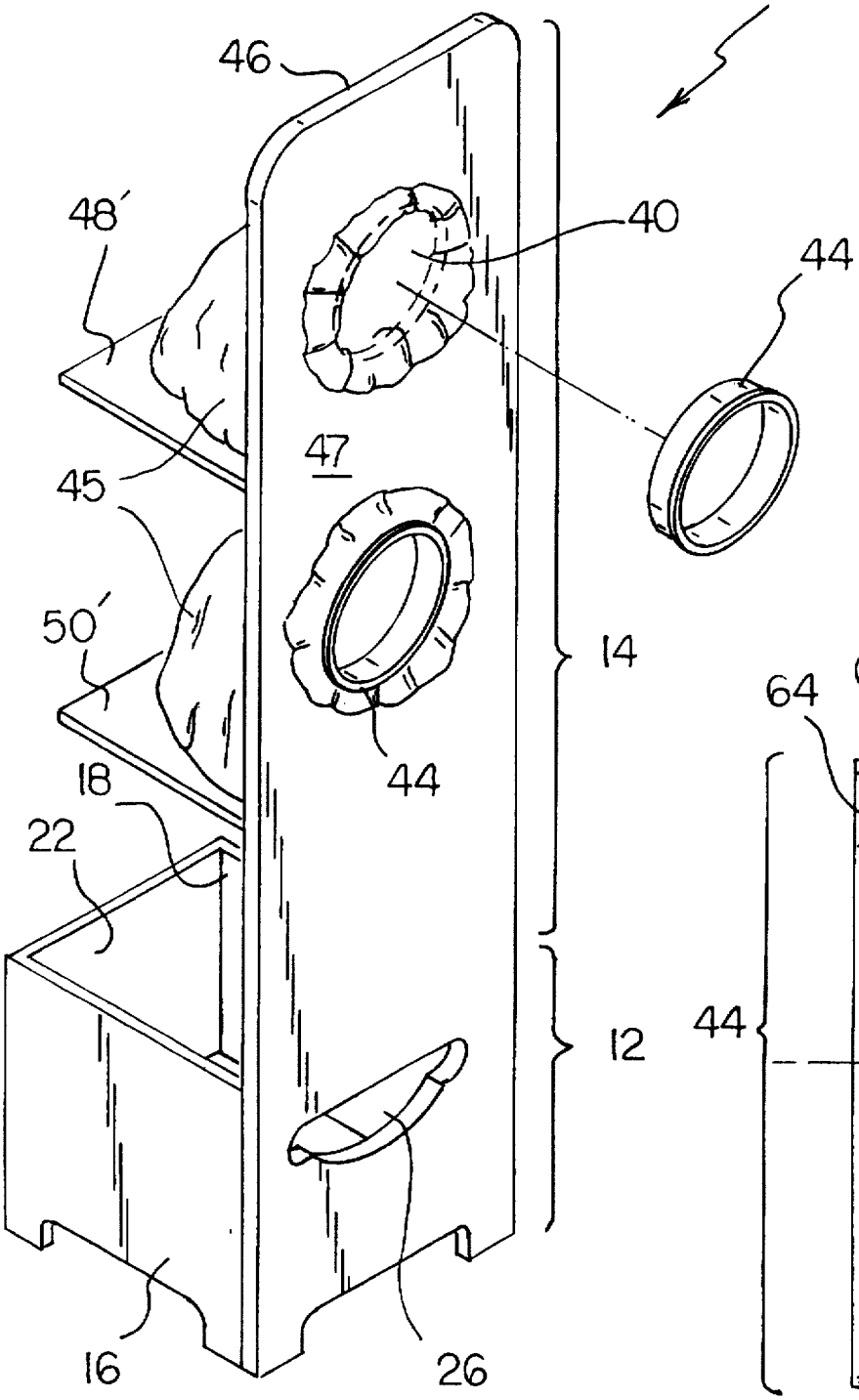
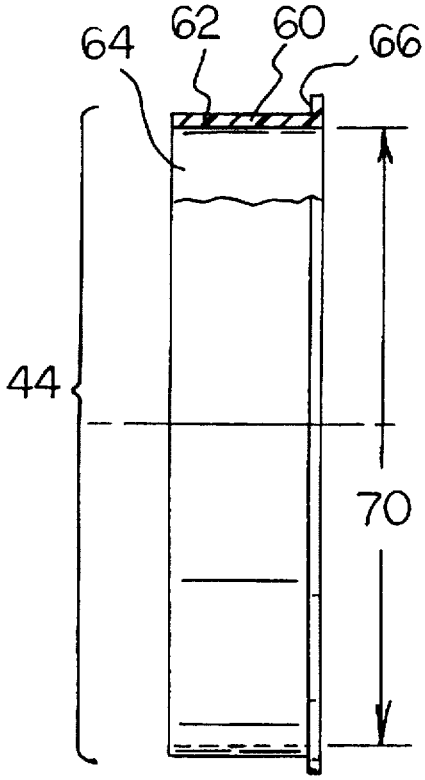
FIG 8

80
40
45
14
47
48'

76
40
44'
78
84
47
72
45
82
80
74

STORING AND SORTING RECEPTACLE APPARATUS AND METHOD

RELATED APPLICATION

This application is a continuation-in-part of my prior application Ser. No. 29/047,009; filed Nov. 24, 1995, now U.S. Pat. No. D. 379,015.

BACKGROUND OF THE INVENTION

1. Field of the Invention

The present invention relates generally to a method and apparatus for storing diverse articles, and more specifically, to a unique receptacle for storing diverse articles especially, though not necessarily, those intended for recycling.

2. Description of the Prior Art

The use of bins or receptacles for holding or storing articles intended to be recycled generally is known in the prior art. More specifically, the following patents describe various receptacles for storing recyclable articles: U.S. Pat. No. 5,398,838; U.S. Design Pat. Nos. 314,512 and 333,742; U.S. Pat. Nos. 5,101,997; and 5,148,932.

While these devices fulfill their respective, particular objectives and requirements, the aforementioned patents do not disclose nor suggest a storing and sorting receptacle having the same combination of advantages of compact size, flexible storage of different type articles, low cost, ease of maintenance, attractiveness of appearance and other desirable characteristics, as does the present invention.

In these respects, the storing and sorting apparatus according to the present invention substantially departs from the conventional concepts and designs of the prior art, and in so doing provides an important contribution to the art of storage receptacles.

SUMMARY OF THE INVENTION

Briefly described, the present invention relates to a method and apparatus for sorting and storing diverse articles wherein the apparatus comprises a base assembly and an integral upstanding storage panel assembly associated therewith. The base assembly forms a bin for receiving articles to be stored and serves the dual function of providing stabilizing support for the entire receptacle. The upstanding storage panel has a front face, a rear face, one or more openings extending orthogonally therethrough, and one or more shelves, each extending rearwardly from the rear face proximal to a corresponding aperture, respectively. A removable, annular closure assembly in the form of a collar member insertable into each aperture is provided for temporarily attaching the open-end portion of a flexible storage bag to the panel assembly in the region of a corresponding opening with the remainder or closed-end portion of the storage bag extending rearwardly and reposing on its corresponding shell Articles of a first type are adapted to be passed through the elongated transverse slot in the lower portion of the panel assembly for deposit in the base assembly bin whereas articles of a second type are adapted to be passed through the openings in the panel assembly defined by each collar member for deposit in a corresponding flexible storage bag reposing on its shelf behind the front face of the panel assembly.

There has thus been outlined, rather broadly, the more important features of the invention in order that the de, tailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new method and apparatus for storing and sorting diverse articles which has many advantages and many novel features that are not anticipated, rendered obvious, suggested, or even implied by any of the prior art receptacle devices, either alone or in any combination thereof.

It is another object of the present invention to provide a new apparatus for storing and sorting diverse articles which may be easily and efficiently manufactured and marketed.

It is a further object of the present invention to provide a new apparatus for storing and sorting diverse articles which is of a durable and reliable construction.

Still another object of the present invention is to provide a new apparatus for storing and sorting diverse articles especially such articles as are intended for recycling.

Yet another object of the present invention is to provide a new apparatus for sorting and storing diverse articles which occupies a minimum amount of floor space.

Still another object of the present invention is to provide a new apparatus for storing and sorting articles of diverse type that has an attractive overall appearance.

Yet still another object of the present invention is to provide a new apparatus for storing and sorting articles of diverse type that is easy and inexpensive to maintain.

Still another object of the present invention is to provide a new apparatus for storing and sorting articles of diverse type that is arranged in an upstanding configuration with a bottom base assembly for storing one type of article and one or more upper facilities for storing articles of a second or different type.

These together with other objects of the invention, along with the various features of novelty and construction which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a perspective view of the invention showing an exploded view of a closure member portion thereof.

FIG. 8 is a cross-sectional view of the closure member shown in FIG. 7.

DESCRIPTION OF THE PREFERRED EMBODIMENT

Figures 1, 2:
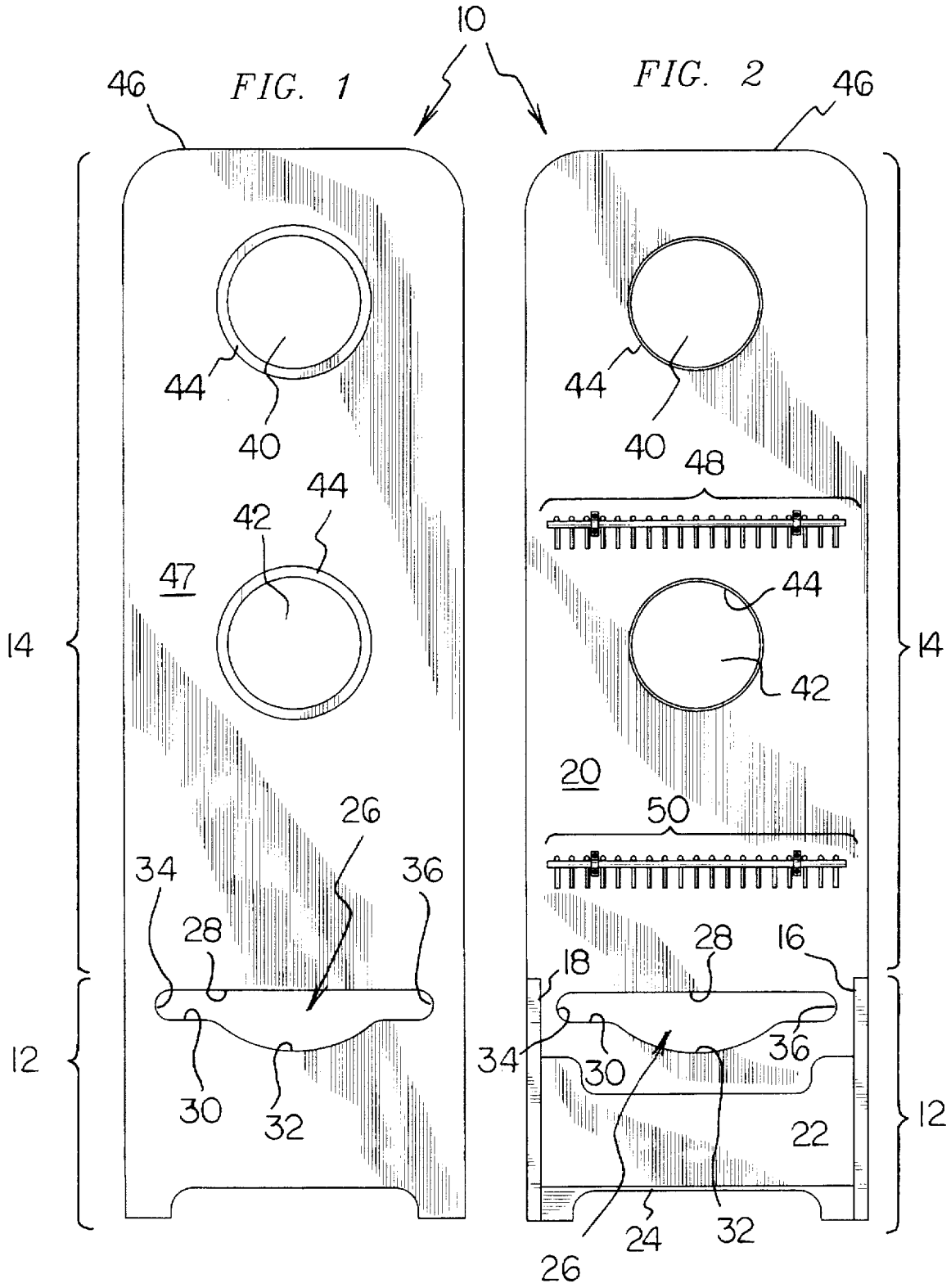
FIG. 1 is a front elevation view of a receptacle for sorting and storing recyclable articles according to the present invention.
FIG. 2 is a rear elevation view of the present invention.
Figures 3, 4:
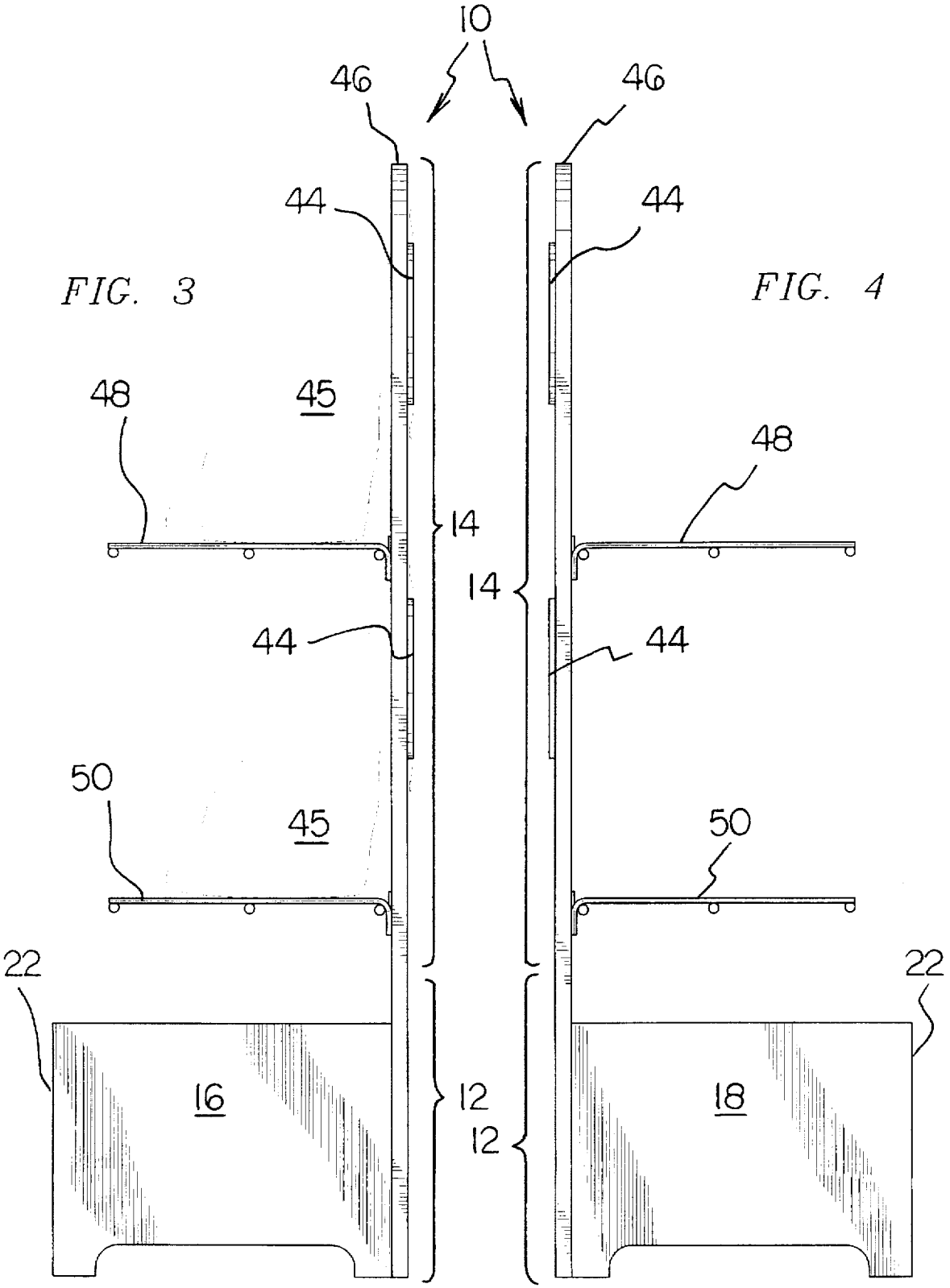
FIG. 3 is a left side elevation view of the invention.
FIG. 4 is a right side elevation view of the invention.
Figure 5:
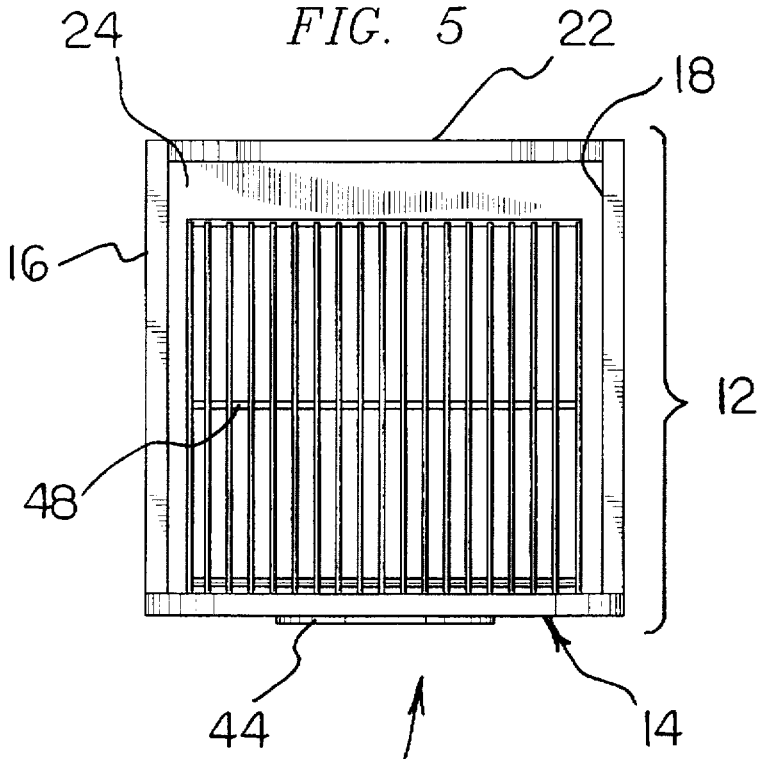
FIG. 5 is a top plan view of the invention.
Figure 6:
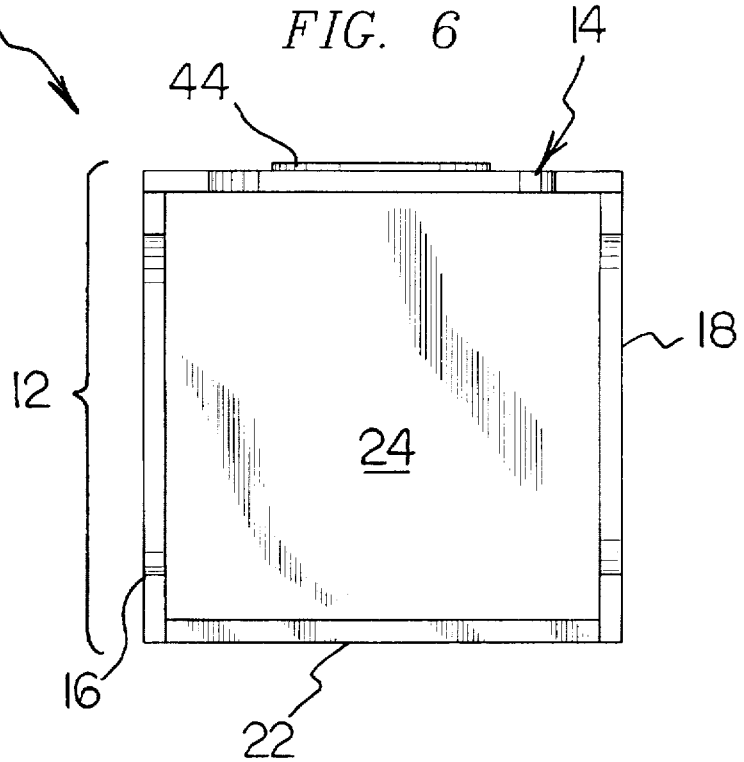
FIG. 6 is a bottom plan view of the invention.

With initial reference now to FIGS. 1–6 of the drawings, a new method and apparatus for storing and sorting diverse articles embodying the principles and concepts of the present invention will be described.

More specifically, a receptacle apparatus for diverse articles generally represented by reference numeral 10 comprises a base assembly 12 and a storage panel assembly 14 associated therewith. In accordance with the present invention, the storage panel assembly is integral with the base assembly and extends upwardly therefrom so that the base assembly supports the storage panel assembly in an upright manner or configuration substantially as shown.

Base assembly 12 comprises a first side wall 16 and a second side wall 18 extending rearwardly with respect to rear surface 20 of panel assembly 14. A third rear wall 22 extending transversely with respect to first and second side walls 16, 18 is joined therebetween along its opposed edges. A fourth bottom wall 24 is joined at its edges to first and second side walls 16, 18 and third wall 22, respectively, to form a bin or rectangular shaped compartment having an upwardly facing opening at the base or bottommost portion of panel assembly 14 with the panel assembly per se forming the front wall of the bin. By this construction, panel assembly 14 is integral with the bin or base assembly 12 and the latter provides enhanced stabilizing support for the upstanding panel assembly 14.

Located in panel assembly 14 is a transverse elongated slot or opening generally indicated by reference numeral 26 positioned proximal to and slightly above the upward extremity of rear wall 22 to serve as a mouth or receiving port for relatively flat recyclable articles such as newspapers, magazines or the like. The shape of slot 26 is defined by a straight top edge 28, a bottom straight edge 30 with an arcuate downwardly depending (curved) central portion 32, and opposed rounded opposed side edges 34, 36. Slot 26 is sized large enough to facilitate the easy passage of such flat recyclable materials from the front side of the panel assembly into the bin where they may remain deposited for storage until removed. It will be appreciated that the weight of the newspapers, magazines, and so on, deposited in the bin of base assembly 12 increases stabilization of the upstanding panel assembly and substantially prevents the entire receptacle 10 from being accidentally tipped over or unnecessarily moved about.

It will be observed that the bottom edge of the panel assembly and the bottom edge of side walls 16 and 18 each has a recessed portion terminating in rounded side edges to define a pair of leg extensions at the opposed corners thereof, respectively. Optionally, however, the leg extensions may be dispensed with and the base assembly 12 (and integral panel assembly 14) placed directly on a horizontal supporting surface with the bottom surface of wall 24, the bottom edge of panel assembly 14 and the bottom edges of sidewalls 22 and 24 all lying in a common plane and engaging the supporting surface directly (e.g. see FIG. 7).

As best seen in FIGS. 1, 2 and 7, panel assembly 14 preferably includes a pair of circular through apertures or openings 40, 42 spaced apart from each other and centered on the central axis of the panel assembly substantially as shown. A collar or ring 44 is frictionally fitted to the inside edge of each opening, respectively. FIGS. 8 illustrates, in enlarged detail, a first preferred form of collar 44 comprising a cylindrically shaped axial body portion 60 having an outer surface 62, an inner surface 64 and an annular lip or flange 66 extending radially from one end of body portion 60. Collar 44 preferably is fabricated of flexible plastic material such as poly vinyl chloride, but may be fabricated of other materials, if desired. The outer diameter of axial body portion 60 is sized to slightly interfere with the diameter of apertures 40, 42 so that when the body portion is axially inserted within a corresponding aperture the collar will yield slightly because, of its polymeric constituency, but securely frictionally engage the panel assembly material surrounding the aperture and be retained therein.

Preferably, and as depicted in the drawings, aperture 40 is proximal to the top edge 46 of panel assembly 14 and provides a through opening between the front surface 47 of the panel assembly and rear surface 20 thereof extending orthogonally therebetween. Aperture 42 is intermedially located between aperture 40 and the upwardly facing opening of the bin formed by base assembly 12 and also provides a through opening between the front surface 47 of the panel assembly and rear surface 20 thereof extending orthogonally therebetween.

A first shelf 48 extends orthogonally and rearwardly from rear surface 20 and is suitably fastened to rear surface 20 by brackets and screws, or the like, in a position between aperture 40 and aperture 42. Similarly, a second shelf 50 extends orthogonally and rearwardly from rear surface 20 and is suitably fastened to rear surface 20 by brackets and screws, or the like, in a position between aperture 42 and bin receiving slot 26. In accordance with the invention, each shelf 48, 50 provides a supporting surface for a flexible plastic storage bag 45, or like container, adapted to have its closed or bottom end portion rest on the shelf and have its upper or open end portion securely removably attached to the front surface 46 of panel assembly 14 by means of a corresponding removable closure member 44 as will be explained in greater detail below. The flexible plastic bag 45 is indicated in broken-line outline and is shown further in FIG. 7. Such flexible plastic storage bags, quite well known as "garbage bags," are widely commercially available and per se form no part of the present invention. Without limiting the invention, and generally speaking, such "garbage bags" typically have a closed bottom end and an upper open end whose diameter is essentially the same dimension as the closed bottom of the bag.

Preferably, each shelf 48, 50 is of the type comprising plastic-coated metal rods attached together in an open grill-work array. Such shelving material is especially light in weight, yet durable and long lasting, and is widely commercially available in "do-it-yourself" stores. The open grill-work shelving illustrated in FIGS. 2–5 per se forms no part of the present invention, it being understood that other shelving material may be used instead. Thus, for example, FIG. 7 depicts, alternatively, simple solid shelves 48', 50' which may be fabricated of wood, aluminum, masonite or other well-known construction materials, the precise choice depending only upon personal dictates.

In carrying out the present invention, and with reference now to FIG. 7, after removing the collars 44 from their respective openings (apertures 40, 42) in panel assembly 14, a separate flexible storage bag 45 is positioned on each shelf 48, 50 (or 48', 50'), respectively, with the open upper end of each bag being brought through the corresponding aperture in a direction from the rear surface 20 to the front surface 47. After folding the bag material back against the front surface of the panel assembly, as shown, for example, with respect to aperture 40 in FIG. 7, the collars are re-inserted into the upper open portion of the flexible storage bag and the corresponding openings 40, 42 such that the outer surface of each collar's axial body portion frictionally engages the corresponding bag between the outer surface 62 of the axial body portion and the inside edge of the panel defined by each aperture thereby securely retaining the bag in the position substantially as shown in FIG. 7 with respect to aperture 42 (see also FIG. 3). Articles may then be deposited into the storage bags on shelf 48, 50 (or 48', 50') by passing such articles through the openings defined by each collar 44 securely, albeit removably, attached to the front surface of the panel assembly. When it is desired to remove a bag on a particular shelf, the corresponding collar 44 is removed by grasping the collar's flange 66 and pulling the collar away from panel assembly front surface. If desired, a conventional flat-bladed screw driver or butter knife blade may be inserted underneath the flange, i.e. between the flange and the front surface of the panel assembly, to facilitate prying the collar out from its corresponding aperture during the withdrawal process. The flexible bag with its contents may then be taken to a recycle station, or otherwise disposed of, and a new empty bag installed on its corresponding shelf by repeating the process as described above.

It will be appreciated that in use, the end of axial body portion of collar 44 opposite to flange 66 is inserted within apertures 40, 42, respectively, to secure the flexible bag therein as best illustrated in FIG. 7. The collar, when seated in its corresponding aperture, maintains the bag in place and furthermore keeps the opening defined by the aperture open to facilitate the passage therethrough of various articles to be deposited into the bag 45 reposing on and being supported by the rearwardly disposed shelf corresponding to the opening and to a person facing front surface, 47 of panel assembly 14, for all intents and purposes out of line of sight behind the panel assembly. Hence, the inner diameter of collar 44 defines a central passage of sufficient size to permit articles to easily be passed through the panel assembly and into a selected storage bag supported behind the opening in which the collar is inserted. The diameter of the central opening of ,collar 44 is indicated by dimension 70 in FIG. 7. As will be evident to persons of ordinary skill in the recycle art, dimension 70 is of sufficient magnitude to easily permit the passage of commonly used three-dimensional articles suitable for recycling such as, by way of example, aluminum soda cans, glass bottles for beer, plastic containers for juice or spring water, or the like.

From the foregoing it is apparent that collar 44 serves as a removable annular closure member for temporarily fastening a flexible storage bag or container (e.g. a plastic garbage bag) to the panel assembly, and more specifically, within an aperture provided in the panel assembly, as will be described in even more detail below.

Figures 9, 10:
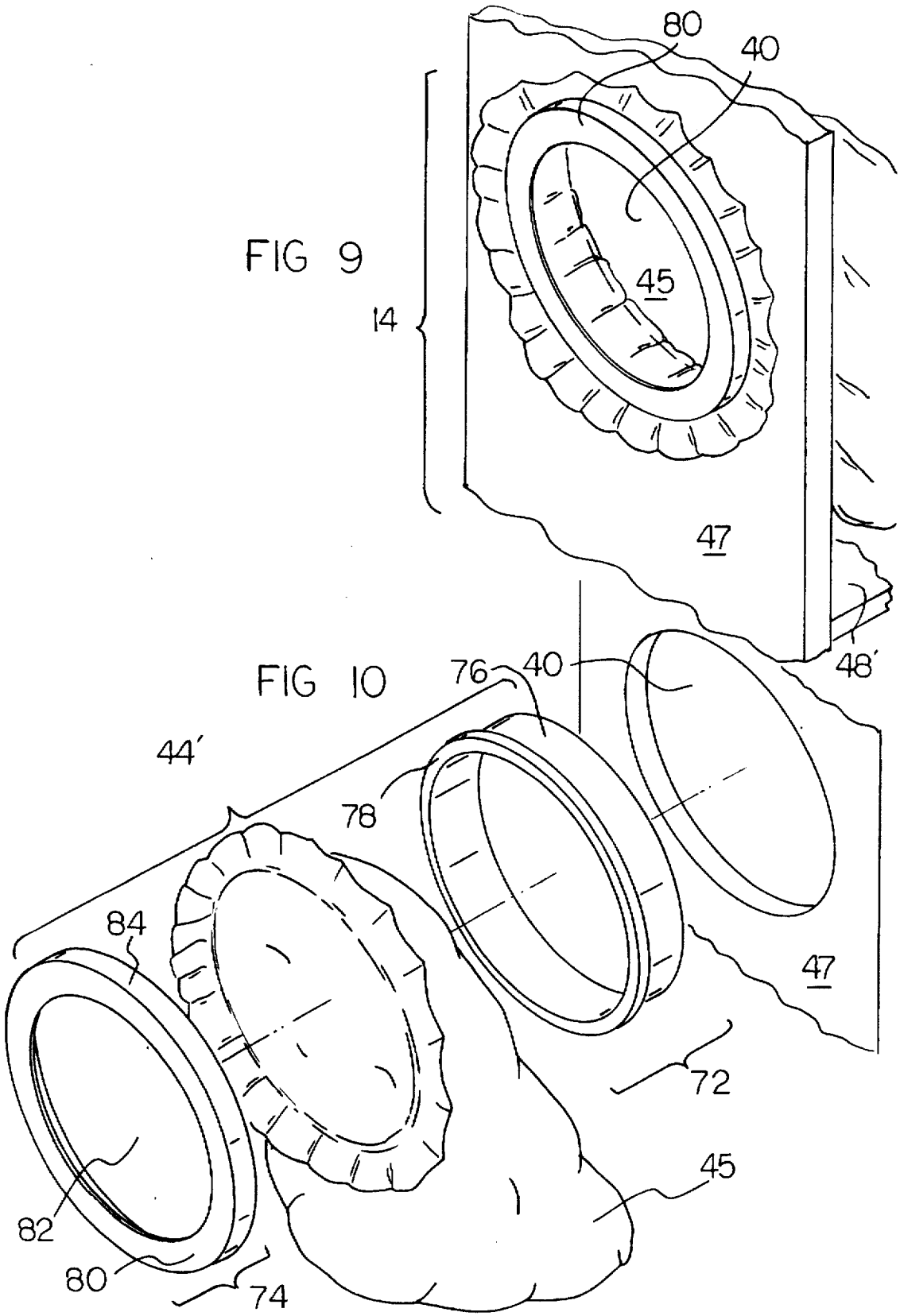
FIG. 9 is a perspective view showing an alternatively preferred embodiment of the closure member used with the present invention.
FIG. 10 is a perspective exploded view of the closure member of FIG. 9.

Turning now to FIGS. 9 and 10 there is illustrated an alternatively preferred embodiment of removable annular closure member in the form of a two-piece collar 44' comprising a first body portion 72 and a second lid portion 74 serving as a cap member for said first body portion. That is, portions 72 and 74 are adapted to be matingly engaged one with the other. First body portion 72 is quite similar to collar 44 and includes a cylindrical portion 76 and a radially extending annular flange 78 at one end of the body portion. Second lid portion 74 includes a relatively thin annular top section 80 defining a central opening 82 and a cylindrical skirt section 84 of like thickness depending orthogonally therefrom. The cylindrical portion 76 of first body portion 72 has an outer diameter sized to securely frictionally fit within aperture 40 whereas the inner diameter of skirt section 84 is sized to securely frictionally engage the outside diameter of flange 78 received therein.

In using the alternatively preferred embodiment (collar 44'), the first body portion initially is inserted into aperture 40. Then the bag outer rim portion is threaded or brought through the opening defined by the inner diameter of cylindrical portion 76 and folded back over annular flange 78. The second lid portion 74 next is fitted over both the folded-back upper bag portion and the flange 78 to secure the bag in the opening substantially as shown in FIG. 9. It will be noted that in the position shown, the second lid portion central opening 82 provides a suitable passage through which articles may be deposited into the bag 45 reposing on the shelf 48' proximal to aperture 40 and extending rearwardly from the panel assembly's rear surface. To remove the bag after a quantity of articles, recyclable or otherwise, has been deposited therein through central opening 82 and aperture 40 (or 42), all that is necessary is to remove second lid portion 74 from flange 78 and draw the bag out rearwardly through its corresponding aperture. A new bag may then be secured to and within the aperture and the panel assembly by repeating the installation process described above.

As to a further discussion of the manner of usage and operation of the present invention, the same should be apparent from the above description. Accordingly, no further discussion relating to the manner of usage and operation will be provided.

The receptacle 10 may be fabricated of wood, plastic, aluminum, other metal, or other durable materials.

Although the preferred embodiments described above are especially intended for use in storing and sorting recyclable articles, it is to be appreciated that the principles of the present invention are independent of the precise nature or characteristics of the articles being processed. Suffice it to say, that in its broadest sense, the present invention provides novel means and methods for storing and sorting various articles without regard to their ultimate nature or disposition.

Therefore, with respect to the above description, it is to be realized that all equivalent relationships to those illustrated in the drawings and described in the specification are intended to be encompassed by the present invention, and further, that the foregoing description is considered as illustrative only of the principles of the invention. Because numerous modifications and changes will readily occur to those skilled in the art, it is not desired to limit the invention to the exact construction and operation shown and described, and accordingly, all suitable modifications and equivalents may be resorted to, falling within the scope of the invention as defined only in the appended claims.

What is claimed as being new and desired to be protected by Letters Patent of the United States is as follows:

1. Apparatus for sorting and storing articles, comprising:

a base assembly, an integral upstanding storage panel assembly, said base assembly providing support for said upstanding storage panel assembly, said upstanding storage panel assembly having a front face, a rear face, and at least one opening extending orthogonally therethrough between said front face and said rear face, and at least one support extending rearwardly from said rear face proximal to said at least one opening for supporting a first removable storage means communicating with said at least one opening, wherein said base assembly comprises a receptacle defining a second storage means, said upstanding panel assembly having at least another normally open passage extending orthogonally therethrough between said front face and said rear face, and wherein said another passage communicates with said receptacle defining said second storage means such that articles passed through said passage and stored in said receptacle provide enhanced stabilizing support for said upstanding panel assembly.

2. The apparatus of claim 1 further including a removable attaching member in the form of an annular collar member adapted to be insertable into said at least one opening for temporarily attaching a first portion of the storage means to said panel assembly front lace with a second portion of said storage means reposing on said at least one support extending rearwardly from said rear face of said panel assembly.

3. The apparatus of claim 2 wherein said storage means is a flexible bag, said first portion is the open end of said bag, and said second portion is the closed end of said bag.

4. The apparatus of claim 1 further including at least one other opening extending orthogonally through said panel assembly between said front face and said rear face, at least one other support extending rearwardly from said rear face proximal to said at least one other opening for supporting another removable storage means communicating with said at least other opening.

5. The apparatus of claim 4 wherein said upstanding panel assembly has a central longitudinal axis, and said one opening and said one other opening are spaced longitudinally with respect to each other along said longitudinal central axis of said panel assembly.

6. The apparatus of claim 1 wherein said at least one support extending rearwardly from said rear face proximal to said at least one opening for supporting a removable storage means communicating with said at least one opening comprises a shelf affixed to said rear surface of said panel assembly above said base assembly.

7. The apparatus of claim 6 wherein said shelf is an open grillwork.

8. The apparatus of claim 1 wherein said another passage is elongated transversely with respect to said upstanding panel assembly for facilitating the passage of a flat article into said bin from a position remote with respect to said front face of said panel assembly.

9. Apparatus for sorting and storing articles, comprising:

a base assembly, an integral upstanding storage panel assembly, said base assembly providing support for said upstanding storage panel assembly, said upstanding storage panel assembly having a front face, a rear face, and at least one opening extending orthogonally therethrough between said front face and said rear face, and at least one support extending rearwardly from said rear face proximal to said at least one opening for supporting a removable storage means communicating with said at least one opening, said apparatus further including removable attaching means for temporarily attaching said storage means to said panel assembly such that said storage means is in communication with said at least one opening, wherein said removable attaching means comprises an annular member having a central opening therein, first and second opposed ends, and a radially extending flange on one of said ends, said annular member being sized to be received within said at least one opening for attaching said storage means to said panel assembly.

10. The apparatus of claim 9 wherein said removable attaching means further includes a cap member adapted to be fitted over said flange at said one end thereof.

11. The apparatus of claim 10 wherein said cap member comprises a flat ring and a cylindrical skirt orthogonally depending therefrom, the diameter of said skirt being sized to receive said flange therein with said storage means therebetween.

12. The apparatus of claim 9 wherein said at least one opening has a size and shape for facilitating the passage of a three-dimensional article into said storage means from a position remote with respect to said front face of said panel assembly.

13. The method of storing and sorting articles, comprising the following steps:

(a) providing apparatus comprising a base assembly, an integral upstanding storage panel assembly, said base assembly providing support for said upstanding storage panel assembly, said upstanding storage panel assembly having a front face, a rear face, and at least one opening extending orthogonally therethrough between said front face and said rear face, and at least one support extending rearwardly from said rear face proximal to said at least one opening for supporting a removable storage means communicating with said at least one opening, (b) placing a flexible storage container having a closed end and an open end on said support, (c) threading said open end of said flexible storage container through said at least one opening, and (d) temporarily attaching said threaded open end portion of said storage container to said panel assembly.

14. The method of claim 13 comprising the further step (e) of attaching said threaded open end of said storage container to said front face of said panel assembly in the region of said at least one opening.

* * * * *